United States Patent [19]

Schulz et al.

[11] 4,195,389

[45] Apr. 1, 1980

[54] FILAMENT-DRAWING ASSEMBLY FOR SPINNING MACHINE

[75] Inventors: Günter Schulz, Ebersbachs; Konrad Klein, Ebersbach, both of Fed. Rep. of Germany

[73] Assignee: Zinser Textilmaschinen GmbH, Ebersbachs, Fed. Rep. of Germany

[21] Appl. No.: 907,413

[22] Filed: May 18, 1978

[30] Foreign Application Priority Data

Feb. 21, 1978 [DE] Fed. Rep. of Germany ..... 2807269
May 18, 1977 [DE] Fed. Rep. of Germany ..... 2722532

[51] Int. Cl.[2] ..... D01H 1/22; D01H 5/82
[52] U.S. Cl. ..... 19/293; 74/665 G
[58] Field of Search ..... 19/293–295; 64/28 R, 28 M; 57/36, 37, 102; 192/54; 74/337, 665 B, 665 E, 665 G, 665 N

[56] References Cited

U.S. PATENT DOCUMENTS

| | | | |
|---|---|---|---|
| 2,585,113 | 2/1952 | Gredell | 62/28 R |
| 2,875,645 | 3/1959 | Keyser | 57/102 X |
| 3,213,709 | 10/1965 | Bjork | 74/665 G |

FOREIGN PATENT DOCUMENTS

| | | | |
|---|---|---|---|
| 183545 | 4/1907 | Fed. Rep. of Germany | 19/293 |

*Primary Examiner*—Werner H. Schroeder
*Attorney, Agent, or Firm*—Karl F. Ross

[57] ABSTRACT

An assembly of filament-drawing rollers, used for stretching rovings or fiber bundles in a spinning machine, is divided into a plurality of stages each including an elongate driven roller and a set of coacting counter-rollers, the driven rollers being interconnected at both ends by respective gear trains for rotation at predetermined relative speeds by a motor driving one of these gear trains. In order to prevent any overstressing of the mechanism if nonmatching gears are inadvertently inserted into the two gear trains, a torque limiter in the form of a shearing bolt or a friction clutch is interposed between at least one driven roller and an associated driving gear. Advantageously, the torque limiter is provided with a device generating an alarm signal upon relative rotation, due to overload, of its input and output shafts respectively joined to the driving gear and the driven roller.

12 Claims, 7 Drawing Figures

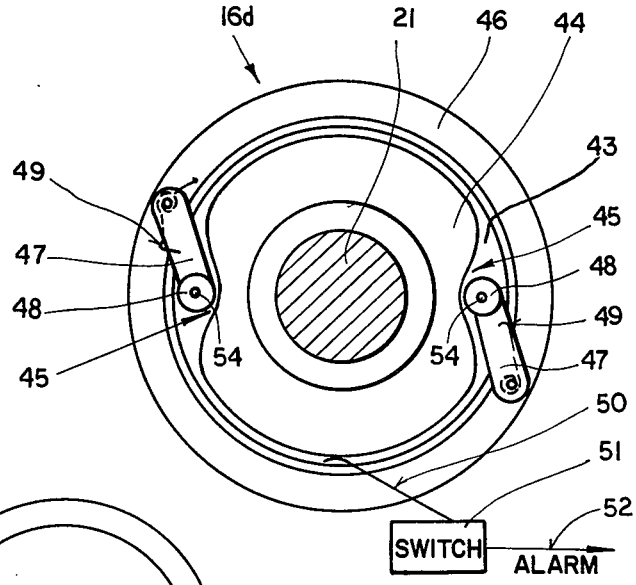
FIG. 5
FIG. 7
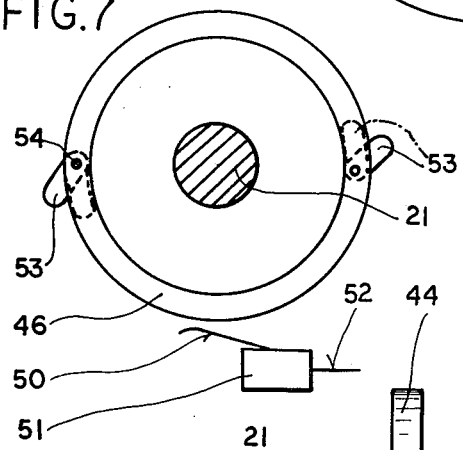
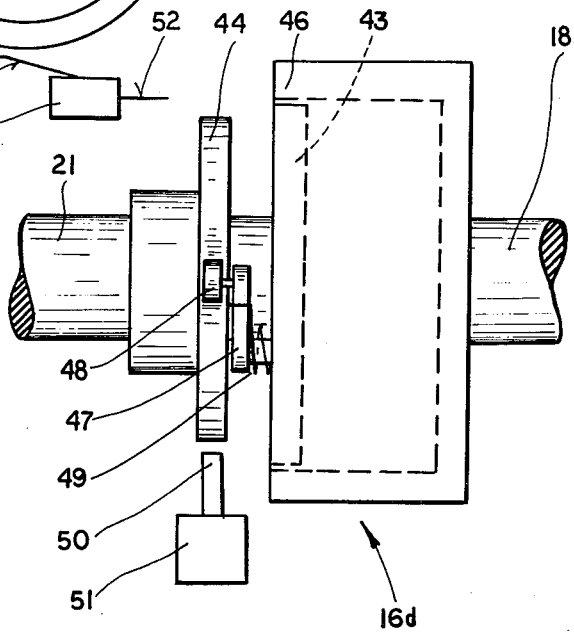
FIG. 6

FILAMENT-DRAWING ASSEMBLY FOR SPINNING MACHINE

FIELD OF THE INVENTION

Our present invention relates to a filament-drawing assembly, particularly for spinning machines, comprising a plurality of cascaded drawing stages each including an elongate driven roller and a set of coacting counterrollers.

BACKGROUND OF THE INVENTION

Assemblies of this type are used for the stretching of rovings or fiber bundles successively traversing the several stages. The driven rollers of these stages are simultaneously rotated at different speeds, progressively increasing from the first stage to the last, by drive means conventionally including a gear train having respective gears positively connected with one end of each driven roller. In order to minimize torsional stresses in these rollers, it has already been proposed to connect the other end of each driven roller with a respective gear of a second gear train which matches the first gear train whereby substantially identical torques are applied to opposite ends of each driven roller; such an arrangement is the subject matter of commonly owned U.S. patent application Ser. No. 832,701 filed by one of us, Günter Schulz, jointly with others on Sept. 12, 1977.

In order to change the relative speed of the several drawing stages in such an assembly, certain gears of the two gear trains will have to be replaced from time to time. If, through inadvertance, nonmatching gears are confrontingly inserted into these trains at such an occasion, the affected stage or stages could be severely overstressed with resulting damage to the mechanism.

OBJECTS OF THE INVENTION

The general object of our present invention, therefore, is to provide means in such a filament-drawing assembly for protecting its mechanism from damage due to overload, particularly to a torsional overstressing as discussed above, while facilitating continued operation until the defect can be remedied.

A more particular object is to provide means for generating an alarm signal in the event of such an overload without necessarily interrupting the operation of the assembly.

SUMMARY OF THE INVENTION

We realize these objects, in accordance with our present invention, by the interposition of torque-limiting means between one end of at least one driven roller and the corresponding gear drivingly connected thereto, the torque-limiting means having an input shaft rigid with the driving gear and an output shaft rigid with the driven roller which rotate in unison during normal operation but at different speeds in the event of an overload.

In a simple case the torque-limiting means may be constituted by a frangible link member, such as a transverse bolt or pin, interconnecting the two shafts. When an overload occurs, the link member is ruptured and the driven roller rotates at the speed imparted to it by the opposite gear train. After the defect becomes apparent, preferably through the intervention of an alarm device as described hereinafter, the operator will stop the machine and correct the defect giving rise to the overload; the broken link member will then have to be replaced. No such replacement is needed where the torque limiter is designed as a friction clutch.

The alarm device advantageously used in our system comprises a signal generator operatively coupled with one of the two shafts, preferably by being carried on the corresponding member of a friction clutch used as the torque limiter. As long as the shafts rotate at the same speed, the signal generator is inactive and no alarm is given. If, however, the shaft speeds differ, the generator is activated to emit a sound, trip a switch or otherwise attract the attention of the operator.

In a particularly advantageous arrangement, torque limiters according to our invention are inserted in different drawing stages on opposite sides of the roller assembly. This will provide additional protection in certain cases of overload not caused by mismatched gears.

BRIEF DESCRIPTION OF THE DRAWING

The above and other features of our invention will now be described in detail with reference to the accompanying drawing in which:

FIG. 5 is an end view of a further friction clutch, similar to the one shown in FIG. 3, provided with an external signal generator;

FIG. 6 is a side-elevational view of the clutch and signal generator shown in FIG. 5; and FIG. 7 is an end view similar to FIG. 5, showing a modification.

SPECIFIC DESCRIPTION

Figure 1:
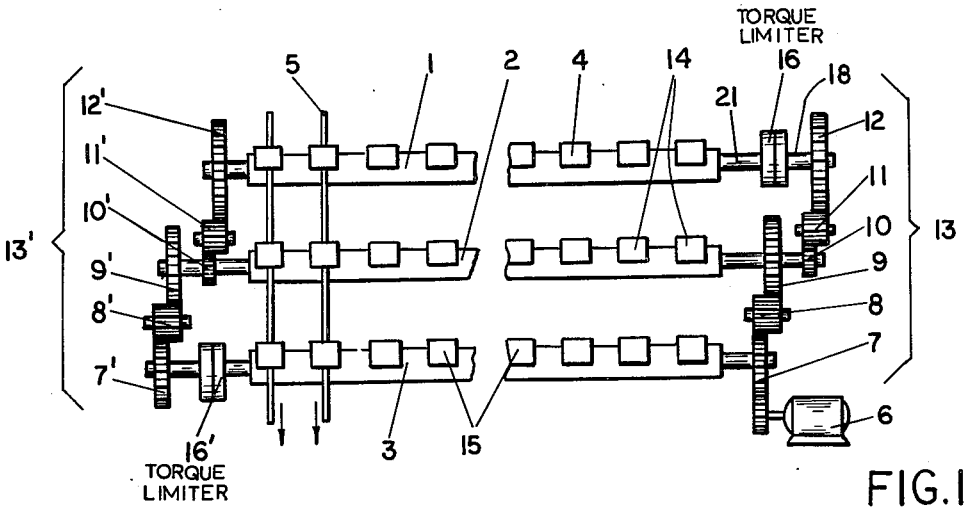
FIG. 1 is a somewhat diagrammatic view of a filament-drawing assembly according to our invention.

The filament-drawing assembly shown in FIG. 1, associated with a nonillustrated spinning machine, comprises a cascade of drawing stages including respective elongate driven rollers 1, 2 and 3 coacting with sets of counterrollers 4, 14 and 15. Fiber bundles 5 move successively through these three stages, as indicated by arrows, for progressive stretching before being delivered to the spinning machine.

The rollers 1–3 are simultaneously rotated, at progressively increasing speeds, by a motor 6 through a gear train 13 including a gear 7 positively connected with the right-hand end of the third-stage roller 3, an intermediate pinion 8, a gear 9 positively connected with the right-hand end of the second-stage roller 2, two further pinions 10, 11, and a gear 12 drivingly connected with the right-hand end of the first-stage roller 1 via an input shaft 18, a torque limiter 16 and an output shaft 21. A matching gear train 13' on the opposite side of the roller array comprises gears 7'–12'; gear 7' is drivingly connected with the left-hand end of roller 3 by way of a torque limiter 16', substantially identical with torque limiter 16, whereas gears 9' and 12' are positively connected with the left-hand ends of rollers 2 and 1, respectively.

It will be noted that the rollers 1–3 and the gear trains 13, 13' form two closed transmission loops, one of them encompassing the rollers 1 and 2 while the other includes the rollers 2 and 3. An accidental mismatch of the gears of either loop will set up torsional stresses therein which, in the absence of torque limiters 16 and 16', would have a destructive effect. Devices 16 and 16' are so designed as to keep their respective input and output shafts rotating in unison during normal operation, i.e. when the torque transmitted by the input shaft lies within or only slightly above a predetermined range, but to decouple these shafts from each other when the driving torque approaches a critical limit.

If an overload should occur for reasons other than a mismatch of confronting gears, e.g. because of a jamming of the first drawing stage 1, 4 by a misplaced object, the assembly will also be protected against damage since both torque limiters 16 and 16' will then cut out.

Figure 2:
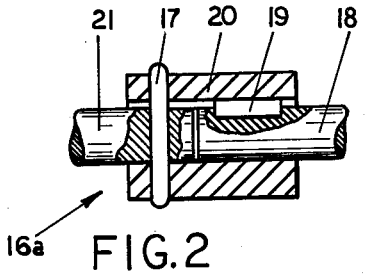
FIG. 2 is a side view, partly in section, of a torque limiter adapted to be used with the assembly of FIG. 1.

In FIG. 2 we have shown a simple torque limiter **16*a*, adapted to be used for either of the devices 16, 16' in FIG. 1, which comprises a sleeve 20 rotatably entrained by the input shaft 18 through a key 19; sleeve 20 partly surrounds the output shaft 21 with which it is linked by a shearing bolt 17 traversing the latter. The shear strength of bolt 17 is so chosen that it is fractured in the event of an overload so that the shafts 18 and 21 are free to rotate relatively to each other. Upon removal of the overload-causing condition, the fragments of bolt 17** are removed and replaced by a new bolt again calibrated to break in the presence of an excessive torque.

Figure 3:
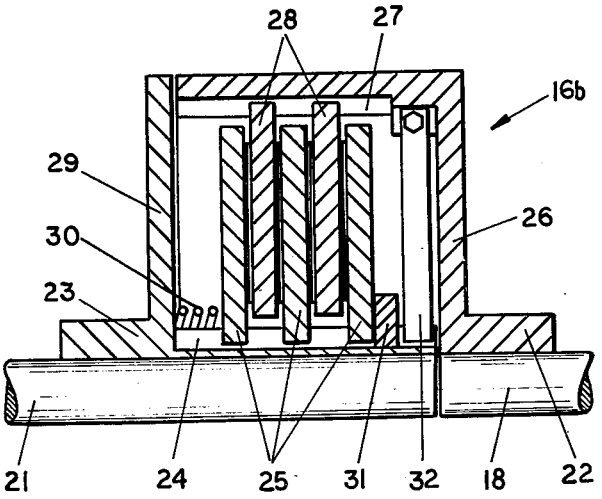
FIG. 3 is an axial sectional view of the upper half of a friction clutch also usable as a torque limiter in the assembly of FIG. 1.

FIG. 3 shows a torque limiter **16*b* which comprises a friction clutch with two members 26 and 29 having hubs 22 and 23 rigid with shafts 18 and 21, respectively. Member 26 forms a cylindrical housing around two sets of interleaved annular disks 25 and 28 which are slidably guided by axially extending outer ribs 24 on member 29 and inner ribs 28 on member 26, respectively. The stack of disks 25, 28 is compressed between a coil spring 30 and an abutment ring 31, the latter being fixedly secured to member 29. Friction layers on the confronting disk faces insure their joint rotation within the range of normal torques. In the event of an overload, determined by their frictional coefficient and by the force of spring 30, a relative slippage occurs between clutch members 26 and 29 so that shafts 18 and 21** are effectively decoupled.

A leaf spring 32 secured to the inner peripheral wall of clutch member 26 has a free end normally resting on one of the ribs 24 or extending into a space between two such ribs so as to be engaged by them for generating a rattling noise upon relative rotation of shafts 18 and 21.

Figure 4:
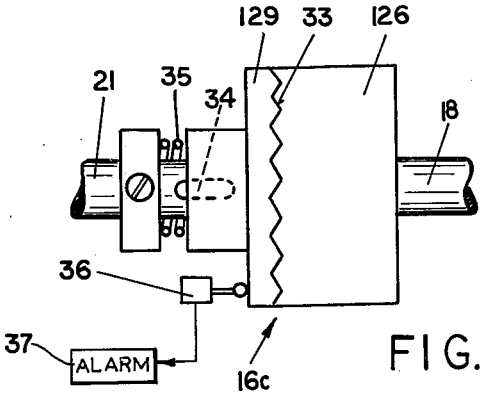
FIG. 4 is a side-elevational view of a modified friction clutch according to our invention.

In FIG. 4 we have shown a torque limiter **16*c* comprising a similar friction clutch with members 126 and 129, the former being fixedly secured to its shaft 18 whereas member 129 is only rotatably coupled with shaft 21 by a key 34 and is axially slidable, in a direction away from member 126, against the force of a compression spring 35**.

The two clutch members 126 and 129 are provided with coacting camming formations in the shape of peripheral serrations or undulations 33 normally held in mating engagement by the pressure of spring 35. When an overload causes these clutch members to slip, member 129 is cammed to the left and trips a malfunction-sensing switch 36 which actuates an alarm indicator 37.

FIGS. 5 and 6 illustrate a torque limiter **16*d* which comprises a friction clutch similar to those shown in FIGS. 3 and 4, with juxtaposed members 43 and 46 respectively carried on shafts 21 and 18. A cam disk 44, also rigid with shaft 21, has two diametrically opposite peripheral recesses 45 normally engaged by cam-follower rollers 48 on a pair of swingable arms 47 which are fulcrumed on clutch member 43 by pivot pins 54 and are biased inwardly by springs 49. The pressure of these springs should be sufficient to resist the centrifugal force acting upon the rollers 48 during rotation, yet this centrifugal force could also be balanced by a weighted outward extension of each arm 47** beyond its pivotal axis.

A feeler 50 of a sensing switch 51, stationary alongside disk 44, extends toward the periphery of that disk but is not engaged by the rollers 48 unless a relative rotation of shafts 18 and 21 forces these rollers out of their recesses 45. In such a case the switch 51 is tripped and energizes an output lead 52 to actuate an alarm indicator such as the one shown at 37 in FIG. 4.

The cam disk 44 could also be disposed inside the housing formed by clutch member 46. In such a case, as illustrated in FIG. 7, pivot pins 54 of cam-follower arms 47 (FIGS. 5 and 6) may have extensions 53 which are normally retracted into the outline of member 46 (as indicated in dot-dash lines) but project radially outwardly, as shown in full lines, upon relative rotation of shafts 18 and 21 so as to trip the sensing switch 51.

We claim:

1. A filament-drawing assembly comprising:

a plurality of cascaded drawing stages each including an elongate driven roller and a set of coacting counterrollers;

drive means for simultaneously rotating said driven rollers at different speeds, said drive means including a first gear train with respective gears drivingly connected to one end of each of said driven rollers and a second gear train with respective gears drivingly connected to the other end of each of said driven rollers, confronting gears of said first and second gear trains matching each other to apply substantially identical torques to the ends of each driven roller;

torque-limiting means interposed between an end of at least one of said driven rollers and the corresponding gear drivingly connected thereto, said torque-limiting means having an input shaft rigid with said corresponding gear and an output shaft rigid with said one of said driven rollers, said shafts rotating in unison during normal operation but at different speeds in the event of an overload; and signal-generating means operatively coupled with said shafts for giving an alarm indication upon relative rotation thereof.

2. An assembly as defined in claim 1 wherein said torque-limiting means comprises a frangible link member interconnecting said shafts.

3. An assembly as defined in claim 1 wherein said torque-limiting means comprises a friction clutch.

4. An assembly as defined in claim 1 wherein said torque-limiting means comprises a first torque limiter interposed between said first gear train and an end of one driven roller, and a second torque limiter interposed between said second gear train and an end of another driven roller.

5. A filament-drawing assembly comprising:

a plurality of cascaded drawing stages each including an elongate driven roller and a set of coacting counterrollers;

drive means for simultaneously rotating said driven rollers at different speeds, said drive means including a first gear train with respective gears drivingly connected to one end of each of said driven rollers and a second gear train with respective gears drivingly connected to the other end of each of said driven rollers, confronting gears of said first and second gear trains matching each other to apply substantially identical torques to the ends of each driven roller; and torque-limiting means interposed between an end of at least one of said driven rollers and the corresponding gear drivingly connected thereto, said torque-limiting means having an input shaft rigid with said corresponding gear and an output shaft rigid with said one of said driven rollers, said shafts being interconnected by a frangible link member for rotating in unison during normal operation but at different speeds upon rupture of said link member in the event of an overload.

6. An assembly as defined in claim 5 wherein said link member comprises a shearing bolt on one of said shafts traversing an axial extension of the other of said shafts.

7. A filament-drawing assembly comprising:

a plurality of cascaded drawing stages each including an elongate driven roller and a set of coacting counterrollers;

drive means for simultaneously rotating said driven rollers at different speeds, said drive means including a first gear train with respective gears drivingly connected to one end of each of said driven rollers and a second gear train with respective gears drivingly connected to the other end of each of said driven rollers, confronting gears of said first and second gear trains matching each other to apply substantially identical torques to the ends of each driven roller; and a friction clutch interposed between an end of at least one of said driven rollers and the corresponding gear drivingly connected thereto, said friction clutch having an input shaft rigid with said corresponding gear and an output shaft rigid with said one of said driven rollers, said shafts rotating in unison during normal operation but at different speeds upon slippage of the friction clutch in the event of an overload.

8. An assembly as defined in claim 7 wherein said friction clutch comprises two juxtaposed members respectively carried on said shafts for joint rotation therewith, further comprising signal-generating means operatively coupled with at least one of said members for giving an alarm indication upon a relative displacement of said members due to overload.

9. An assembly as defined in claim 8 wherein said members are provided with concentric arrays of axially extending ribs and with respective sets of annular disks slidably guided on said ribs in interleaved relationship, said signal-generating means comprising a resilient blade on one of said members having a free end engageable with the ribs of the other of said members upon relative rotation thereof.

10. An assembly as defined in claim 8 wherein said members are provided with coacting camming formations tending to separate said members axially against a counteracting spring force upon relative rotation thereof, said signal-generating means comprising a sensor positioned for actuation by an axial shift of said one of said members.

11. An assembly as defined in claim 7, further comprising a peripherally recessed cam disk on one of said shafts, a radially movable cam follower on the other of said shafts biased into engagement with said disk, and signal-generating means including a sensor positioned for actuation by said cam follower upon a radially outward movement thereof to give an alarm indication in the event of relative rotation of said shafts.

12. A filament-drawing assembly comprising:

a plurality of cascaded drawing stages each including an elongate driven roller and a set of coacting counterrollers;

drive means for simultaneously rotating said driven rollers at different speeds, said drive means including a first gear train with respective gears drivingly connected to one end of each of said driven rollers and a second gear train with respective gears drivingly connected to the other end of each of said driven rollers, confronting gears of said first and second gear trains matching each other to apply substantially identical torques to the ends of each driven roller;

torque-limiting means interposed between an end of at least one of said driven rollers and the corresponding gear drivingly connected thereto, said torque-limiting means having an input shaft rigid with said corresponding gear and an output shaft rigid with said one of said driven rollers, said shafts rotating in unison during normal operation but at different speeds in the event of an overload;

a peripherally recessed cam disk on one of said shafts;

a radially movable cam follower on the other of said shafts biased into engagement with said disk; and signal-generating means including a sensor positioned for actuation by said cam follower upon a radially outward movement thereof to give an alarm indication in the event of relative rotation of said shafts.

* * * * *